US005970588A

United States Patent [19]

Hurtz et al.

[11] Patent Number: 5,970,588

[45] Date of Patent: Oct. 26, 1999

[54] UNLOCKABLE SNAP FASTENER

[75] Inventors: Winifred Hurtz, Stolberg; Michael Schwarz, Herne, both of Germany

[73] Assignee: William Prym GmbH & Co. KG, Stolberg, Germany

[21] Appl. No.: 09/101,744

[22] PCT Filed: Dec. 8, 1996

[86] PCT No.: PCT/EP96/05677

§ 371 Date: Jul. 16, 1998

§ 102(e) Date: Jul. 16, 1998

[87] PCT Pub. No.: WO97/28714

PCT Pub. Date: Aug. 14, 1997

[30] Foreign Application Priority Data

Feb. 6, 1996 [DE] Germany ..... 196 04 131

[51] Int. Cl.[6] ..... A44B 17/00

[52] U.S. Cl. ..... 24/657; 24/654; 24/658

[58] Field of Search ..... 24/657, 658, 656, 24/655, 654, 546

[56] References Cited

U.S. PATENT DOCUMENTS

| | | | |
|---|---|---|---|
| 1,265,869 | 5/1918 | Arkin | 24/657 |
| 1,305,979 | 6/1919 | Cobe . | |
| 1,363,291 | 12/1920 | Thompson | 24/657 |
| 1,380,177 | 5/1921 | Arkin | 24/657 |
| 1,484,807 | 2/1924 | Baker et al. . | |
| 2,629,156 | 2/1953 | Kamens et al. | 24/657 |
| 4,687,236 | 8/1987 | Rasche | 24/657 |

FOREIGN PATENT DOCUMENTS

| | | | |
|---|---|---|---|
| 0291154 | 11/1988 | European Pat. Off. . | |
| 472995 | 12/1914 | France | 24/657 |
| 343131 | 10/1921 | Germany . | |
| 442833 | 8/1966 | Switzerland . | |
| 9635344 | 11/1996 | WIPO . | |

*Primary Examiner*—Victor N. Sakran
*Attorney, Agent, or Firm*—Friedrich Kueffner

[57] ABSTRACT

A snap closure with a male part whose male coupling surfaces have an enlarged closing head at a closing neck, with a two-part female part comprising a housing having an insertion hole for the male coupling surfaces, and with two plate-shaped slides which are identical in shape, spring-loaded in opposite directions, project out on opposite sides of the housing by their outer ends which serve for actuation, and can be pressed in against the spring loading in opposite directions relative to one another transverse to the insertion hole, wherein, on the one hand, the two slides have, in their mutual joint region, complementing closing parts for a common locking profile which engages behind the inserted closing head of the male part when coupling, and, on the other hand, are cut out and have a common release profile for decoupling the closing head, wherein each of the two slides which are made of elastic material are provided at their inner ends with a longitudinally elastic spring portion formed integral with the slides, and in that the free ends of these spring portions are supported alternately at the two slides.

11 Claims, 3 Drawing Sheets

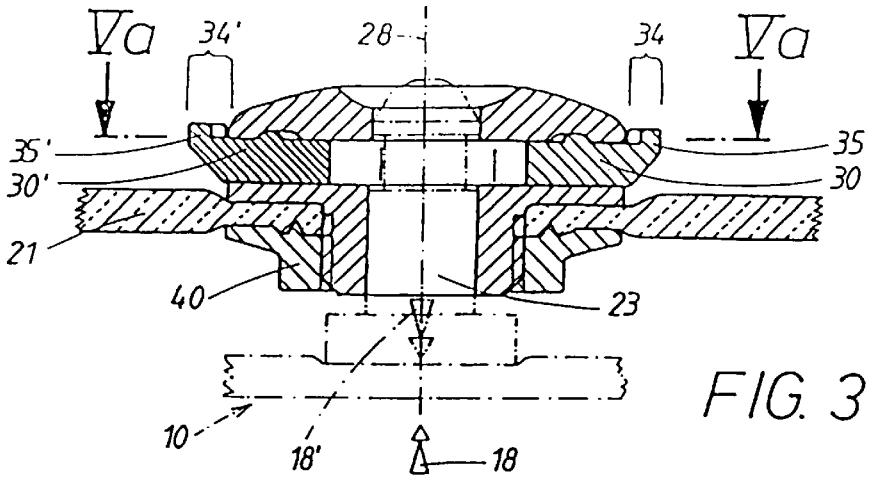
FIG. 3
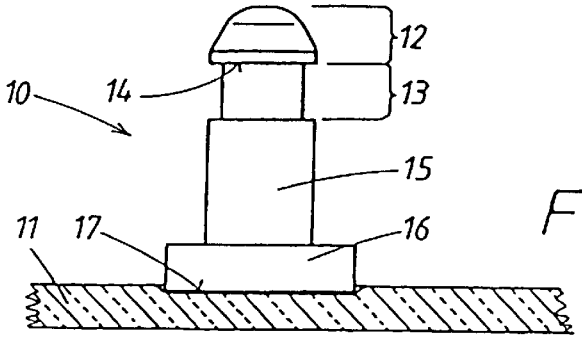
FIG. 4
FIG. 5a
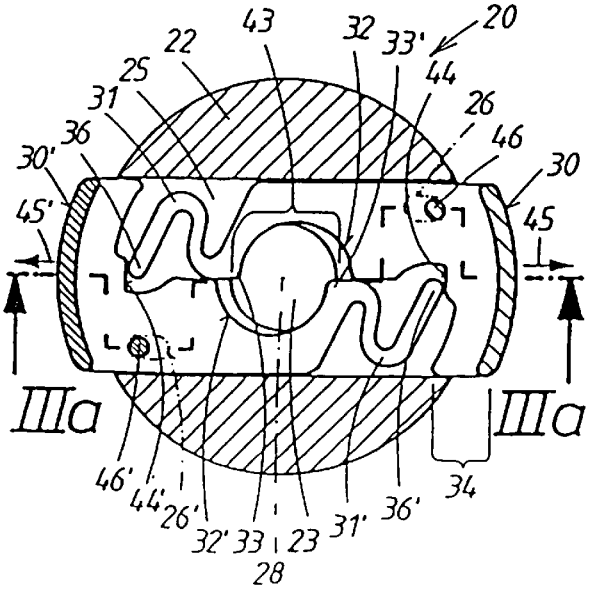
FIG. 5b
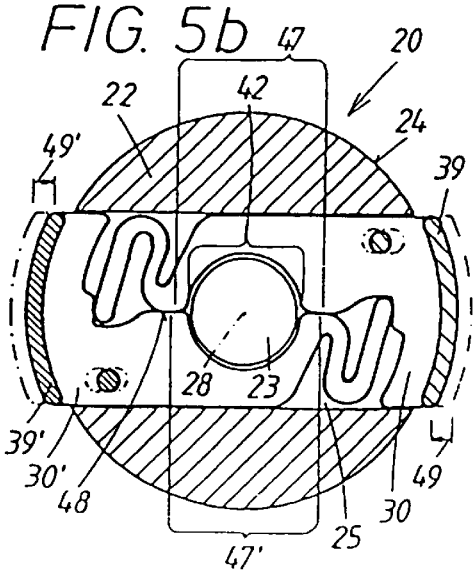

UNLOCKABLE SNAP FASTENER

The invention is directed to a snap fastener or snap closure of the type indicated in the preamble of claim 1. When the closing head of the male part has been inserted axially through the insertion hole in the housing of the female part, this coupling position of the slide is secured by a portion with a locking profile because this portion engages behind the closing head of the male part. In order to unlock, the slide is displaced via its actuating portion in the housing until a slide portion with a release profile is aligned axially with the closing head of the male part.

In a known snap closure of this kind (U.S. Pat. No. 1,305,979), the two plate-shaped slides which are identical in shape have, at their inner ends, guide strips which engage alternately in longitudinal grooves of the two slides. A pair of stirrup-shaped metal springs, both of whose stirrup legs are supported at laterally projecting projections of the two slides, serve the purpose of spring-loading the slides in opposite directions. Two disks which are mounted in a housing of the female part serve to secure the position of the two slides and the two stirrup springs. The known snap closure has numerous structural component parts which require elaborate individual manufacture and complicated assembly.

In a snap closure of a different kind (DE-PS 343 131) which has only one individual slide, a spring wire whose curved end forms a spring portion is used for its manufacture. This wire end is supported at an inner surface of the housing. The wire portion which then follows in the slide produces the complete locking profile formed of a U-shaped stirrup. This locking stirrup is held by the spring portion in constant alignment with the insertion hole in the housing of the female part serving for axial insertion of the closing head of the male part. One leg of the U-stirrup is then bent out until it is possible to unlock the closing head when this bent out leg region is aligned with the closing head. This is followed by a U-shaped loop at the outer end of the wire which forms the actuating portion of the slide. In order to ensure a sufficient push-in movement, this actuating portion must project out of the housing to a considerable extent in the initial position in which the above-mentioned U-stirrup is aligned with the insertion hole in the housing. Not only does this impair the appearance of the known snap closure, but, because of its large radial overlap, causes objects which move past it to become hooked thereon in an unwanted manner. However, a substantial disadvantage consists in that the U-stirrup acting as locking profile is rigid, per se, so that a simple snap-in coupling of the male part by means of an axial insertion of the closing head in the female part is impossible. Rather, in order for the male part to be coupled therein, the projecting loop of the slide serving as actuator must first be pressed into the housing until the release portion formed by the above-mentioned bending out of one stirrup leg is aligned axially with the insertion hole in the housing.

The object of the invention is to develop a snap closure of the type indicated in the preamble of claim 1 which can be coupled and uncoupled conveniently, is very economical and can be produced in a simple manner. This object is met, according to the invention, through the steps indicated in the characterizing part of claim 1. The special significance of these steps will be described hereinafter.

The invention requires only two structural component parts in the interior of the housing, namely, the two slides within which the spring portions are already integrated. Elastic material, namely, plastic in particular, is used to produce the slides, wherein longitudinally elastic spring portions can likewise be formed integral thereon. These spring portions enable a very economical arrangement with respect to space because they are supported by their free ends alternately at the other respective slide. The manufacture and assembly of the female part according to the invention is very simple; the slides, i.e., two structural component parts, which are integral with the two spring portions need only be inserted in a housing which can be constructed in a correspondingly simple manner. A one-piece housing can be used. Since all of the structural component parts, even the spring portions, are arranged in the direction in which the plates extend, a very space-saving construction of the female element is achieved.

Further steps and advantages of the invention are given in the subclaims, the following description, and the drawings. The invention is shown in two embodiment examples in the drawings.

FIG. 1*a* shows an axial section through the housing of a female part along section line 1*a*–1*a* of FIG. 1*c;*

FIG. 1*b* shows an axial section through the housing vertical to the section plane of FIG. 1*a;*

FIG. 1*c* is bottom view of the housing of FIGS. 1*a* and 1*b;*

FIGS. 2*a* and 2*b* show a side view and a top view of another structural component part, namely, a slide, to be inserted in the housing of FIGS. 1*a* to 1*c;*

FIG. 3 shows an axial section, corresponding to that of FIG. 1*a*, through the completely assembled slide according to FIG. 2*a*, but in a sectional side view, wherein the slide is fastened to a carrier by means of a counter-holder which can be screwed in;

FIG. 4 shows a side view of a complementary male part belonging to the female part of FIG. 3, this male part being arranged at a carrier;

Figure 6A:
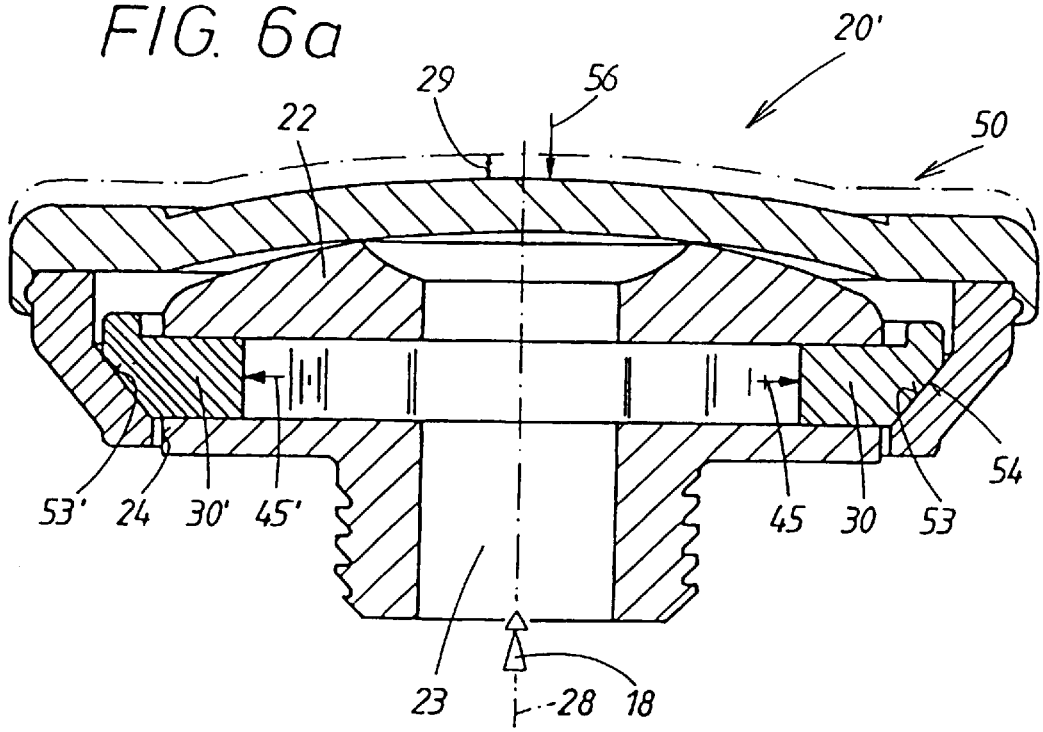
Figure 6B:
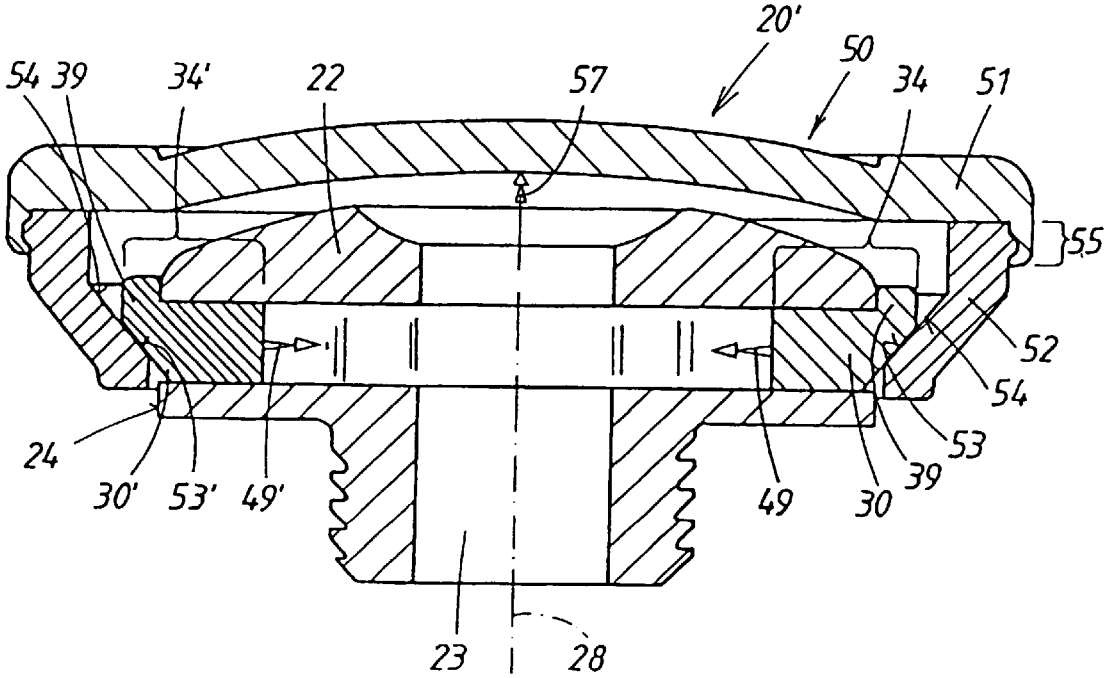

FIGS. 5*a* and 5*b* show horizontal sections through the female part of FIG. 3 along section line V—V in FIG. 3, wherein FIG. 5*a* shows the fully pushed out position of the two slides and FIG. 5*b* shows the fully pushed in position of the two slides;

FIG. 6*a* shows an axial section, corresponding to FIG. 3, through the female part which is complete but not yet fastened to a carrier in an alternative construction having a common handle for actuating both slides and in the completely pushed out position of the slides; and FIG. 6*b* shows a sectional view corresponding to FIG. 6*a* of the same female part in the fully pushed in position of the two slides.

As can be seen from FIGS. 3 and 4, the snap closure according to the invention comprises a female part 20 which is fastened to a first carrier 21 and a male part 10 fitted to a second carrier 11. The two snap parts 10, 20 serve to fasten the two carriers 11, 21 together or detach them from one another, as needed. For this purpose, the two snap parts 10, 20 have mating male and female coupling surfaces.

As can be seen from FIG. 4, the coupling surfaces of the male part 10 are divided into a closing head 12 and a closing neck 13 which is reduced in cross section relative to the closing head 12. In the present case, the coupling surfaces 11 are fitted, via a shaft 15, to an end flange 16 which serves to fasten the male part 10 to its carrier 11. In the illustrated embodiment example, the fastening is carried out by means of a weld connection 17 at the underside of the flange. Naturally, any other fastening steps can be used to attach the male part 10 to the carrier 11, e.g., rivets which are placed from the underside of the carrier 11 and engage, e.g., at the flange 16. Grooved nails which are anchored in the interior of the male part, e.g., in the region of an axial bore hole provided in the shaft 15, can also be used.

As can be seen from the drawings of individual parts shown in FIGS. 1*a* to 2*b*, the female part 20 comprises three component parts, namely, a housing 22 and two slides 30, 30' which are longitudinally movable therein and are constructed so as to be identical to one another with respect to shape, but arranged in a mirror-inverted manner. While the housing 22 could be composed of two housing halves which can be assembled with one another, it is more advantageous, as shown in the embodiment example in FIGS. 1*a* and 1*b*, for the housing 22 to be constructed in one piece. The housing 22 is fastened to the visible or exposed side of the carrier 21. An additional structural component part is used for this purpose, namely, in the present case, a counter-holder 40 which is shown in FIG. 3 and which is arranged in the manner of a nut which can be screwed onto an external thread of the housing 22. It will be understood that any fastening methods, known per se, could be used to arrange the female part 20 on the carrier 21.

The housing 22 initially has a cylindrical insertion hole 23 in the shape of an axial bore hole in which the male coupling surfaces of the male part 10 are inserted for coupling in the insertion direction indicated by arrow 18 in FIG. 4. The insertion axis 28 which is accordingly defined in the housing 22 is indicated in dash-dot lines in FIG. 3. This insertion hole 23 penetrates a channel 25 which passes diametrically through the housing 22 and serves to guide the two slides 30, 30'. The channel 25 opens out at both ends of the housing circumference 24. After assembly, as can be seen from FIG. 3, the two slides 30, 30' project out by their actuating portions 34, 34' which are used for handling them and are located at their outer ends 35, 35'. The assembly of the two slides 30, 30' is carried out in the following manner.

Figure 1A:
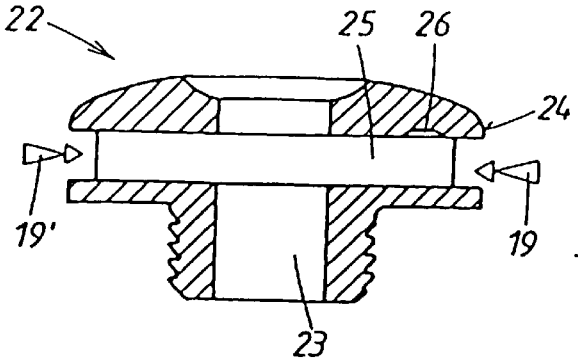
Figure 2A:
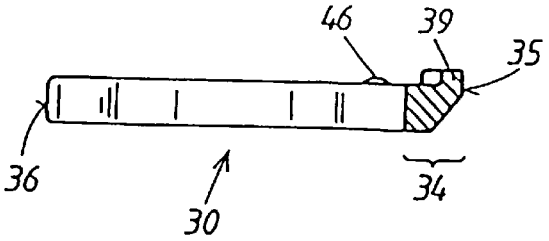
Figure 1B:
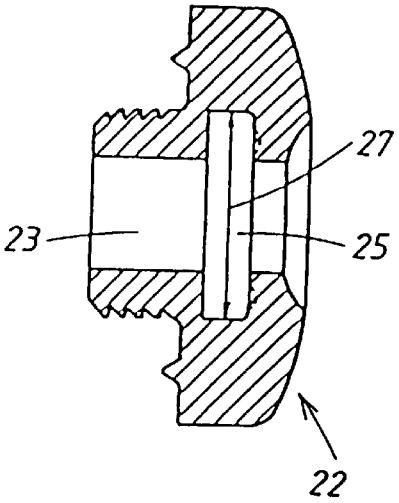
Figure 1C:
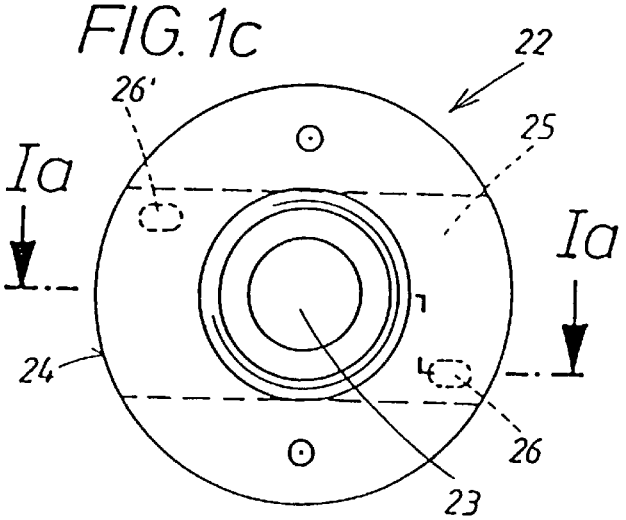
Figure 2B:
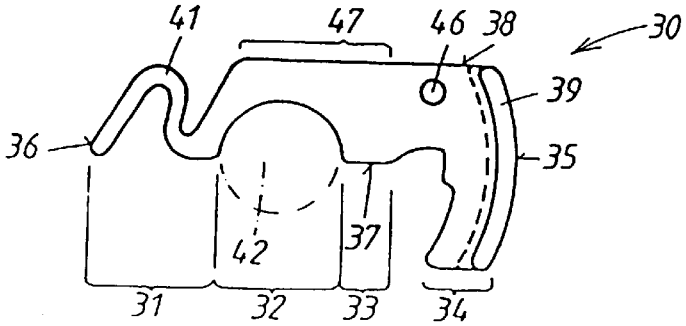

Due to the fact that the two slides 30, 30' are identical in shape, as was already mentioned, it is only necessary to describe one slide 30 according to FIGS. 2*a* and 2*b*. The corresponding areas on the other slide 30' are provided with the same reference numbers in the rest of the Figures, but with the addition of a stroke (') in order to distinguish between them in view of the above-mentioned mirror-inverted attitude of the two slides 30, 30'.

The slide 30 is shaped like a plate, but has, at its outer end 35, a strip-shaped protuberance 39 which extends parallel to the curvature of the housing circumference 24. A projection 46 projects from the plate plane of the slide 30, wherein a slotted link 26 at the inner surface of the channel 25 is associated with this projection 46. Assembly is effected in a simple manner in that the two slides 30, 30' are inserted into the housing channel 25 in opposite directions relative to one another as indicated by assembly arrows 19, 19' in FIG. 1*a* by their inner slide ends 36 and 36', respectively, which will be described more fully hereinafter. Since not only the slides 30, 30' but also the housing 22 are formed, in the present case, of a material such as plastic which is elastic with respect to shape, the projection 46 and the slotted link 26 work together like elements of a snap connection. Thus, when assembled 19, 19' in this way, the projections 46, 46' of the two slides 30, 30' snap into the associated slotted links 26, 26' within the common channel 25 and are then permanently locked therein. The result of this is shown in a sectional view in FIG. 5*a*. In the following, reference is had to the detailed construction shown in FIG. 2*b*.

The substantially planar plate of the slide 30 has a narrow continuation which is bent and therefore forms a longitudinally elastic spring portion 31, 31' of the slide 30. The bent portion is S-shaped in this case. The narrow continuation 41 enables the springing-elastic characteristics of the plate material in this spring portion 31 to come into effect. The actuating portion 34 extends substantially over the entire width 27 of the channel shown in FIG. 1*b* and has an undercut 44 facing the inner end 36 of the slide. After their assembly, the ends 36 and 36' of the two spring portions 31, 31' are supported alternately at the two undercuts 44', 44 of the two slides 30', 30 as can be seen from FIG. 5*a*. The two slides 30, 30' are spring-loaded in the direction of force arrows 45, 45' in FIG. 5*a*. This spring loading 45, 45' acts in the pushing out direction of the two slides 30, 30', respectively. This results in the maximum pushed out position, shown in FIG. 5*a*, which is limited by the projections 46, 46' and slotted links 26, 26' acting as end stops. Thus, the pushed out position shown in FIG. 5*a* is the normally occupied position. In the pushed out position, the insertion hole 23 is narrowed by the housing 22 relative to the cross section of the closing head 12 of the male part 10 of FIG. 4; the clearance width of this insertion hole 23 is then only approximately equal to the diameter of the closing head 12. There is then located in the region of the insertion hole 23 a locking profile 43 which is produced by both slides 30, 30' jointly. The way in which this takes place will be explained hereinafter.

According to FIG. 2*b*, the respective slide 30 is constructed so as to be narrower in its center slide region 47 than in the actuating portion 34, 34' and essentially extends over only half of the channel width 27 mentioned above. Therefore, the two slides 30, 30' can lie with their center slide regions 47, 47' adjacent to one another in the channel 25 as can be seen from FIG. 5*b*. In the region of the joint 48 lying in the longitudinal center plane of the housing channel 25, the two slides come into contact at certain points. FIG. 5*b* shows the fully pushed in position of the two slides 30, 30' which results when the slides have been displaced manually by a relatively short distance 49, 49' against the above-described spring loading 45, 45'. The pushed out position of the two slides 30, 30' shown in FIG. 5*a* is also indicated in dash-dot lines in FIG. 5. The pushed in position in FIG. 5*b* can likewise be limited by the projections 46, 46' and slotted links 26, 26' described with reference to FIG. 5*a*. However, it is simpler to use the above-mentioned strip-shaped protuberances 39, 39' provided at the outer end of the slide, wherein these strip-shaped protuberances 39, 39' would then strike against the housing circumference 24. In the pushed in position of FIG. 5*b*, the insertion hole 23 of the housing 22 is opened up, so that a previously coupled male part 10, indicated by dash-dot lines according to FIG. 3, can easily be uncoupled in the movement direction indicated by arrow 18' shown in a dash-dot line in FIG. 3. As can be seen from FIG. 5*b*, the two slides 30, 30' then form between themselves a common release profile 42. The above-mentioned housing axis defined by the insertion arrow 18 in FIG. 4 during coupling and by arrow 18' in FIG. 3 during uncoupling is also indicated in FIGS. 5*a* and 5*b*.

As can be seen from FIG. 2*b*, each of the two slides 30 is provided in the center region 47 of the slide with an edge profile 37 at the plate edge facing the respective adjacent slide. The oppositely located plate edge 38, on the other hand, is constructed essentially in a straight line and serves for the longitudinal guidance of the respective slide 30 at the channel wall. The edge profile 37 divides the center region 47 of the slide into two functionally distinct portions 32, 33. One portion 32 comprises partial opening areas of the whole release profile 42 shown in FIG. 5*b*, wherein the whole opening profile of the release profile 42 is indicated in FIG. 2*b* by a dash-dot half-circle. In the present case where both slides 30, 30 are identically shaped but arranged in a mirror-inverted manner, each of the two portions 32 makes up half of the release profile 42. The adjacent portion comprises closing parts 33 which combine with the corresponding closing parts 33' in the portion of the other slide 30' to make a common locking profile 43 as can be seen in FIG. 5*a*. As will be clear from FIGS. 5*a* and 5*b*, the associated portions 32, 32' of the common release profile 42 and the two closing parts 33, 33' are mirror-inverted with reference to the housing axis 28 to form the common locking profile 43.

As was already mentioned, the pushed out position of the two slides 30, 30' shown in FIG. 5*a* is the position normally occupied. The male part 10 can now snap into the female part 20 by itself without any actuation of the slides as is known per se in simple snap fasteners which work without locking. However, a snap-in coupling of this kind is carried out in a special way in the invention. Normally, as was described in detail above, the locking profile 43 functioning as a barrier for the coupled in male part is located in the region of the insertion hole 23. However, the closing parts 33, 33' that are decisive for this purpose are positioned in a diametrical arrangement relative to one another with respect to the insertion axis 28, so that during the insertion movement 18 in FIG. 4 they are pushed away from one another radial to the insertion axis 28 by the penetrating closing head 12 until the release profile 42, shown in FIG. 5*b*, which is aligned axially with the insertion hole 23 is formed between the two slides 30, 30'. When the closing head 12 passes through, the two slides 30, 30' are pushed away from one another again due to the fact that they are spring-loaded 40, 40' in opposite directions, so that the two closing parts 33, 33' facing one another move toward one another and engage around the closing neck 13 of the male part as can be seen from FIG. 4. The two snap fastener parts 10, 20 are then locked as is illustrated by dash-dot lines of the male part 10 in FIG. 3. The closing parts 33, 33' engage behind a sharp undercut 14 at the transition point between the closing head 12 and the closing neck 13 of the male part 10. Therefore, a coupling in is only possible through the pressing together of the two slides 30, 30' to the extent of the above-mentioned displacement distance 49, 49' in FIG. 5*b*.

The snap-in coupling of the male part 10 into the female part 20 is facilitated by the tapering of the closing head 12 toward the free end of the male part 10. The pressing apart of the two closing parts 33, 33' which is carried out radial to the insertion axis 28 is also improved in this snap coupling by inclined surfaces in the edge region of the closing parts 33, 33' which lie on the surface side of the two plates which faces the insertion arrow 18. These inclined surfaces can be provided as an alternative to or in addition to the above-mentioned conical or dome-shaped tapering of the closing head 12. In this snap coupling, the closing parts 33, 33' act as "female dome surfaces" of this snap fastener part 20, wherein, however, their elastic effect is derived from the spring loading 45, 45' of their spring portions 31, 31'. This spring force 45, 45' thus has a dual function; it serves not only for automatic locking of the fully coupled in male part 10, but also allows a snap coupling of the male part 10 without manual slide actuation.

In the second embodiment example of the invention according to FIGS. 6*a* and 6*b*, an alternative arrangement 20' of the female part according to the invention is shown which is arranged in conformity with the above-described female part 20 with respect to its basic construction comprising the housing 22 and the two oppositely directed slides 30, 30'; in this respect, reference is had to the preceding description. It will suffice to deal merely with the differences. These differences essentially consist in that the release position of the two slides 30, 30' is controlled directly via a handle 50 in this female part 20', rather than indirectly.

In this case, this handle is formed of a cap 50 which is mounted at the housing circumference 24. The cap 50 is movable by lifting in the direction of the double arrow 29 between the initial position shown in solid lines in FIG. 6*a* and the actuating position shown in FIG. 6*b* and indicated in dash-dot lines in FIG. 6*a*, specifically in the direction of the housing axis 28 which is also indicated in FIG. 6*a*. The cap 50 is formed in two parts for reasons relating to assembly and has a plate-shaped cover part 51, which may possibly be profiled and provided with a pattern on the visible side, and an annular side part 52. The two parts 51, 52 can be assembled one inside the other through suitable circumferential profiling, e.g., by means of a snap-in connection 55. If necessary, the parts 51, 52 can be held together in a nondetachable manner by gluing or welding. It is important that the cap 50 has control surfaces 54 which extend at an inclination toward the axis 28 shown in dash-dot lines and which are arranged at the inner circumference of the annular side part 52. These control surfaces 54 cooperate with the two slides 30, 30', namely, as can be seen from FIG. 6*b*, with the outer edges of their two actuating portions 34, 34'. In the present case, the slides 30, 30' have counter-surfaces 53 and 53' which cooperate with the control surfaces 54 on the cap side and have a corresponding opposite inclination relative to the axis 28 of the female part 20'. This produces the following results.

The two slides 30, 30' tend to move into the pushed out position shown in FIG. 6*a* which corresponds to the factors in the preceding embodiment example which were mentioned with reference to FIG. 5*a*. The two slides 30, 30' are spring-loaded 45, 45' in opposite directions, as is also illustrated by the force arrows in FIG. 6*a*. However, this spring loading also acts on the side part 52 of the cap 50 via the control surfaces 54 and counter-surfaces 53, 53' described above and accordingly generates an axial force component 56 which tends to hold the cap 50 in its axial lowered position shown in FIG. 6*a*. Accordingly, the spring portions 31, 31' of the two slides which were described with reference to the preceding female part 20 and are also provided in this case in an analogous manner take on a third function, namely, that of holding the cap 50 in the defined initial position of FIG. 6*a*.

However, the cap 50 can be lifted manually opposite to this axial force 56 in the direction of the lifting arrow 57 shown in FIG. 6*b*. The two slides 30, 30' are then pushed toward one another in the direction of the arrows 49, 49° described in the preceding embodiment example and shown in FIG. 6*b* against the spring loading 45, 45' acting on them. This movement of the two slides 30, 30' toward one another is concluded when the protuberances 39, 39', which are also provided in the present case, abut at the housing circumference 24 of the female part 20' with their inner edges. The two slides 30, 30' are then in the fully pushed in position corresponding to FIG. 5*b*. Accordingly, it is also no longer possible to pull up the slide 60 in the direction of the lift arrow 57 beyond the extent shown in FIG. 6*b*. In FIG. 6*b*, the cap 50 is located in its maximum axial raised position.

As can be seen from FIG. 6*a*, the cap 50 engages around the housing 22 at the circumference 24 and engages behind the projecting regions of the two slides 30, 30'. The extent of the pushing out movement of the two slides 30, 30' is limited by the spacing between the diametrically opposite regions of the control surface 54 at the cap with which the counter-surfaces 53, 53' located on the slide side make contact. Additional internal stops for limiting the pushing out such as the projections 46 and slotted links 26 described in the preceding embodiment example are therefore superfluous. The two slides 30, 30' are already held by the cap 50 in the transverse channel of the housing 22 so as to prevent them from falling out.

Instead of a cap 50 which is movable axially by lifting, it would also be possible to use a rotating handle at the housing 22 serving to press together 49, 49' the two slides 30, 30' against their spring loading 45, 45'. In this case, the rotating handle has radial control surfaces, e.g., in the form of segments which cooperate with corresponding counter-inclinations at the actuating ends 34, 34' of the two slides, which counter-inclinations which have a runup or stop profile. The spring loading 45, 45' of the two slides also acts in this respect as restoring forces to move a rotating handle of the kind mentioned above into its initial position.

We claim:

1. Snap closure with a male part (10) whose male coupling surfaces have an enlarged closing head (12) at a closing neck (13), with a two-part female part (20) comprising a housing (22) having an insertion hole (23) for the male coupling surfaces, and with two plate-shaped slides (30, 30') which are identical in shape, spring-loaded (45, 45') in opposite directions, project out on opposite sides of the housing (22) by their outer ends (35, 35') which serve for actuation, and can be pressed in (49, 49') against the spring loading in opposite directions relative to one another transverse to the insertion hole (23), wherein, on the one hand, the two slides (30, 30') have, in their mutual joint region, complementing closing parts (33, 33') for a common locking profile (43) which engages behind the inserted closing head (13) of the male part (10) when coupling, and, on the other hand, are cut out and have a common release profile (42) for decoupling the closing head (12), wherein each of the two slides (30, 30') which are made of elastic material are provided at their inner ends (36, 36') with a longitudinally elastic spring portion (31, 31') formed integral with the slides (30, 30'), and in that the free ends of these spring portions (31, 31') are supported alternately at the two slides (30, 30').

2. Snap closure according to claim 1, wherein the housing (22) is formed in one piece and has a common or shared transverse channel (25) for the two slides (30, 30'), the two spring portions (31, 31') of the latter also being arranged in this transverse channel (25).

3. Snap closure according to claim 2, wherein the plate edge (38) located opposite from the profiled joint region (48) is constructed essentially in a straight line and is guided longitudinally at the respective channel wall in the housing (22).

4. Snap closure according to claims 1 wherein each of the outer actuating ends (34, 34') of the two slides (30, 30') is undercut (44, 44'), in that the axial spaces resulting from the undercutting (44, 44') serve to receive alternate spring portions (31, 31'), and in that the undercuts (44, 44') form the supporting surfaces for the free spring ends.

5. Snap closure according to claim 1, the spring portions (31, 31') of the two slides (30, 30') are formed of a narrow, bent plate continuation (41) whose springing elasticity is formed by axial deformation of this bending.

6. Snap closure according to claim 5, wherein the bending extends in the plate plane of the plate-shaped slide (30; 30') and is S-shaped.

7. Snap closure according to claim 1 wherein a handle (50) is arranged at the housing (22), which handle (50) acts simultaneously on both actuating portions (34, 34') of the slides (30, 30') when actuated and moves these slides (30, 30') toward one another (49, 49') against their respective spring loading (45, 45') until the partial regions (33, 33') of the locking profile (43) generated jointly by them are axially aligned with the closing head (12) of the male part (10).

8. Snap closure according to claim 7, wherein the handle (50) is mounted at the circumference (24) of the housing (22) and has control surfaces (59), while the two actuating portions (34, 34') of the slides (30, 30') have, at their ends projecting from the transverse channel (25), counter-surfaces (53, 53') cooperating therewith.

9. Snap closure according to claim 8, wherein the handle comprises a cap (50) at the housing (22) which is movable axially in the direction of the insertion axis (28) of the male part (18) by lifting and which engages radially around the housing (22) at least in the region of the two actuating portions (34, 34') of the slides (30, 30'), and the control surfaces and counter-surfaces (54, 53) extend at an inclination to the axis (28).

10. Snap closure according to claim 9, wherein actuating portions (34, 34') have stops (39, 39') cooperating with shoulders on the housing side, which stops (39, 39') limit the maximum pushed in position of the two slides (30, 30') in the housing (22), in that the partial regions (33, 33') of the common locking profile (43) of the two slides (30, 30') are axially aligned with the closing head (12) of the male part (10) in the pushed in position, and the cap (50) is loaded indirectly, namely via its control surfaces (54) and counter-surfaces (53, 53') on the slide side, by the spring loading (45, 45') of the two spring portions (31, 31') in an axial lowered position in which it is pressed against the housing (22).

11. Snap closure according to claim 10, wherein each of the two stops is formed by a protuberance (39, 39') arranged at the end of the two actuating portions, and an axial pulled up position of the spring-loaded cap (50) bringing about the maximum pushed in position of the two slides (30, 30') is limited by the control surfaces (54) and counter-surfaces (53, 53') in that the protuberance (39, 39') contacts the circumference (24) of the housing (22).

* * * * *

UNITED STATES PATENT AND TRADEMARK OFFICE

CERTIFICATE OF CORRECTION

PATENT NO. : 5,970,588

DATED : October 26, 1999

INVENTOR(S) : Winfried HURTZ et al.

It is certified that error appears in the above-identified patent and that said Letters Patent is hereby corrected as shown below:

On the title page insert item [22], PCT Filed: 18, 1996

Signed and Sealed this

First Day of August, 2000

*Attest:*

*Attesting Officer*

Q. TODD DICKINSON

*Director of Patents and Trademarks*

UNITED STATES PATENT AND TRADEMARK OFFICE

CERTIFICATE OF CORRECTION

PATENT NO. : 5,970,588

DATED : October 26, 1999

INVENTOR(S) : Winfried Hurtz, et al.

It is certified that error appears in the above-identified patent and that said Letters Patent is hereby corrected as shown below:

On the title page, Item [22], should read --[22], PCT Filed: Dec. 18, 1996--.

This Certificate supercedes certificate of correction issued August 1, 2000.

Signed and Sealed this

Seventeenth Day of October, 2000

*Attest:*

Q. TODD DICKINSON

*Attesting Officer*

*Director of Patents and Trademarks*